US006597272B1

(12) United States Patent
Hsu

(10) Patent No.: US 6,597,272 B1
(45) Date of Patent: Jul. 22, 2003

(54) TRANSFORMER HAVING STABILIZED POWER OUTPUT

(76) Inventor: Nien Fu Hsu, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/253,208

(22) Filed: Sep. 20, 2002

(51) Int. Cl.[7] ..... H01F 27/24

(52) U.S. Cl. ..... 336/234; 336/65; 336/67; 336/160; 336/212; 336/213; 336/198

(58) Field of Search ..... 336/234, 184, 336/185, 160, 212, 213, 219, 220, 221, 182, 198, 98, 60, 65, 67, 209, 210; 29/602.1

(56) References Cited

U.S. PATENT DOCUMENTS 2,680,219 A * 6/1954 Gould ..... 336/67
3,745,499 A * 7/1973 Smith ..... 336/160
4,149,135 A 4/1979 Roespel et al. ..... 336/65
4,879,804 A 11/1989 Chiang ..... 29/605

* cited by examiner

*Primary Examiner*—Lincoln Donovan
*Assistant Examiner*—Jennifer A Poker

(57) ABSTRACT

A transformer includes a ferrite base plate having a chamber for receiving a winding and one or more further windings which may be coupled to a ground. The windings are electrically coupled together, and separated from each other by partitions. An insulating strap may be wound around the ferrite base plate, and engaged with the ground, for securing the ground to the ferrite base plate and for preventing the ground to the ferrite base plate from moving relative to the ferrite base plate. One or more conductive panels may be engaged between the partitions of the windings.

4 Claims, 4 Drawing Sheets

TRANSFORMER HAVING STABILIZED POWER OUTPUT

BACKGROUND OF THE INVENTION

1. Field of the Invention

The present invention relates to a starter or a transformer, and more particularly to a starter or a transformer for controlling or for energizing light devices.

2. Description of the Prior Art

Typical starters or transformers are provided for controlling or for energizing the light devices, and comprise a primary winding and a secondary winding engaged around a ferrite core each. U.S. Pat. No. 4,149,135 to Roespel et al., and U.S. Pat. No. 4,879,804 to Chiang disclose two of the typical starters or transformers.

When a high voltage electric power up to 1200 volts is required for energizing some kinds of electric facilities, for example, an addition set of starter or transformer is required and coupled to the starter or transformer, for increasing the voltage up to 1200 volts, and for energizing the light devices, for example.

However, such high voltage may normally provide an over load greater than the light devices may be suffered, such that the fuses for the electric facilities will be easily burned and are required to be replaced with the new ones frequently. In addition, a great cost is required for manufacturing such high voltage starter or transformer.

Furthermore, when such a high voltage may be generated, a great heat or temperature may also be generated relatively, and may also damage the starter or transformer frequently. In addition, much more load or power will be consumed due to the greater heat and high temperature.

The present invention has arisen to mitigate and/or obviate the afore-described disadvantages of the conventional starters or transformers.

SUMMARY OF THE INVENTION

The primary objective of the present invention is to provide a starter or a transformer having a ground for safely controlling or for energizing light devices.

The other objective of the present invention is to provide a starter or a transformer having an insulating strap wound around the transformer for positioning or securing the ground to the transformer.

The further objective of the present invention is to provide a starter or a transformer for providing a stabilized electric power output to energize the light devices.

In accordance with one aspect of the invention, there is provided a transformer for electric facilities, the transformer comprising a ferrite base plate including a chamber formed therein, a first winding and at least one second winding engaged in the chamber of the ferrite base plate, the first and the second windings being electrically coupled together, and separated from each other, a ground coupled to the second winding, and an insulating strap wound around the ferrite base plate, and engaged with the ground, for securing the ground to the ferrite base plate and for preventing the ground from moving relative to the ferrite base plate of the transformer.

The ferrite base plate may include a single one-integral-piece plate, or may include a plurality of plates secured together.

Two or more pairs of partitions may further be provided and engaged in the chamber of the ferrite base plate, and disposed on sides of the first and the second windings respectively.

One or more conductive panels may further be provided and engaged between the two pairs of partitions.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
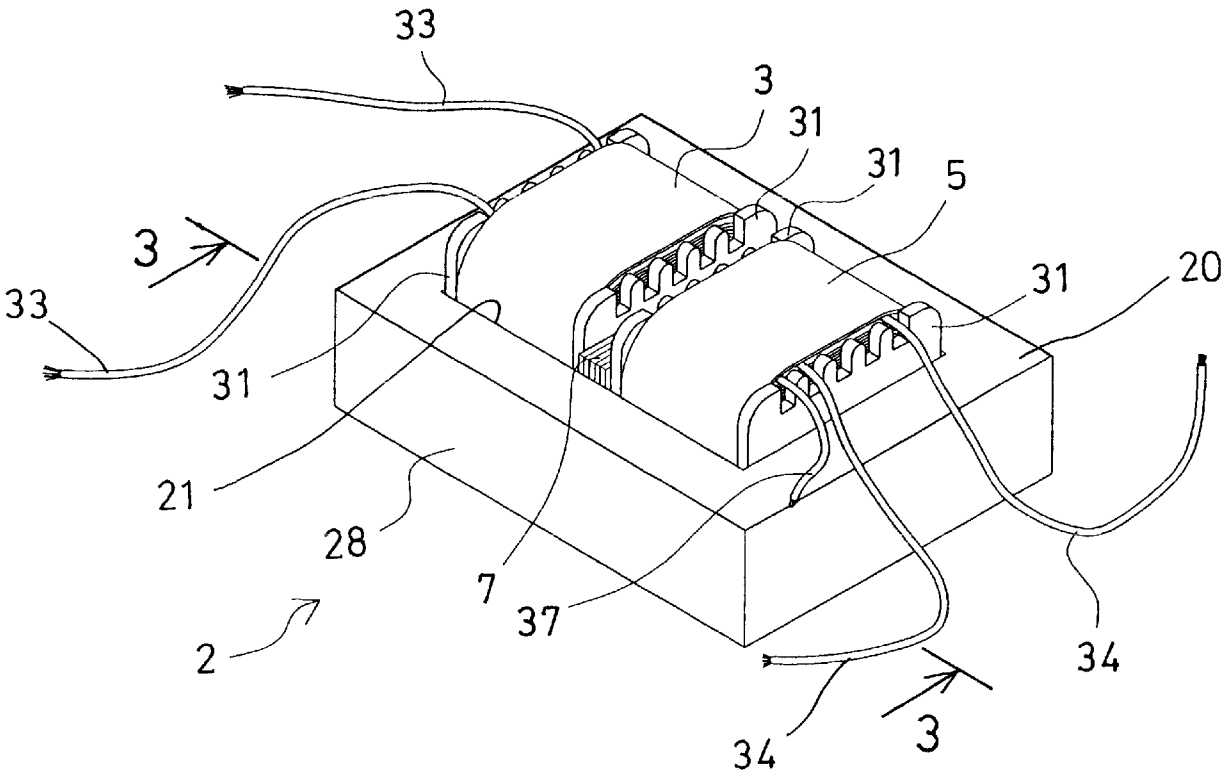
FIG. 1 is a perspective view of a starter or a transformer in accordance with the present invention.
Figure 2:
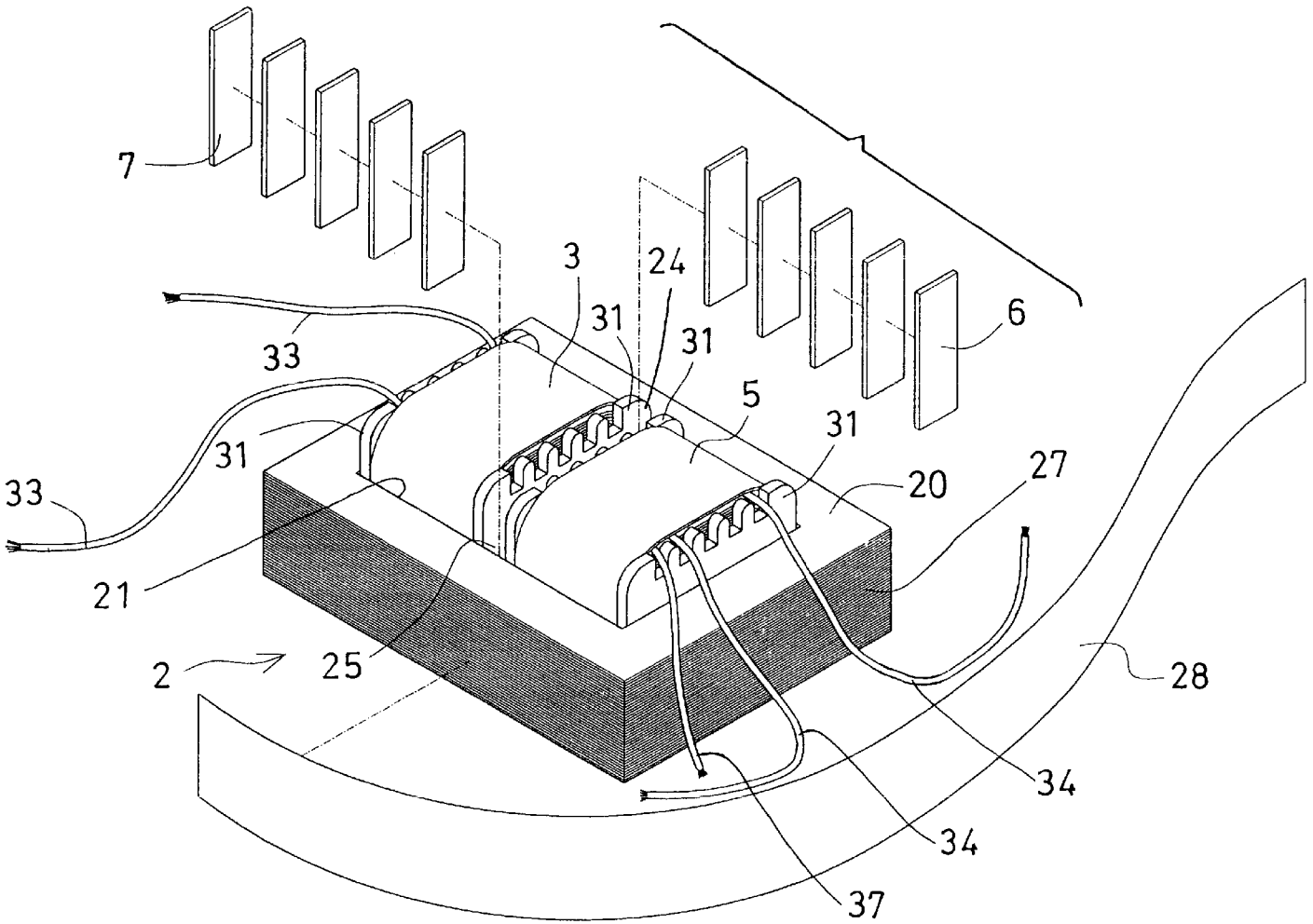
FIG. 2 is a partial exploded view of the starter or a transformer.
Figure 3:
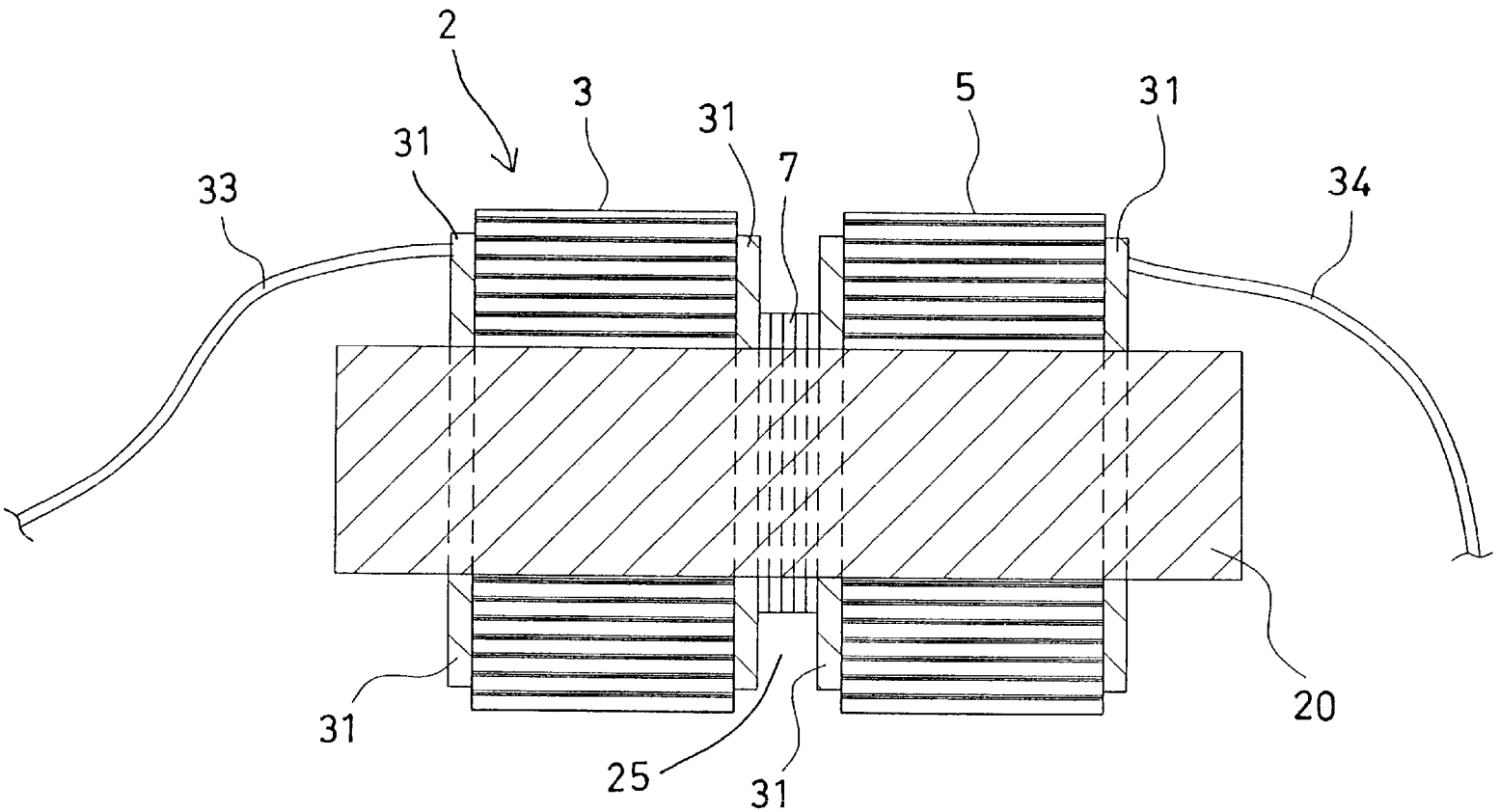
FIG. 3 is a partial cross sectional view taken along lines 3—3 of FIG. 1.

Referring to the drawings, and initially to FIGS. 1–3, a starter or a transformer in accordance with the present invention comprises a ferrite base plate 2 including one or more chambers 21 formed therein, such as two chambers formed therein for forming or defining a ferrite core (not shown) therein. The ferrite base plate 2 may include a one-integral piece 20 (FIG. 3), or may include one or more plates 20 secured together (FIG. 2).

The ferrite core has been shown in a co-pending U.S. patent application Ser. No. 10/199,515, filed on Jul. 17, 2002, which may be taken as a reference for the present invention.

A first winding 3, and one or more further or second windings 5 are engaged in the chamber 21 of the ferrite base plate 2, and wound around the ferrite core for forming two coils (3, 5) in one ferrite base plate 2. Two or more pairs of partitions 31 are also engaged in the chamber 21 of the ferrite base plate 2, and disposed on the sides of the windings 3, 5 respectively.

The windings 3, 5 are electrically coupled together, but separated from each other, such that two spaces 24, 25 may be formed in the chamber 21 of the ferrite base plate 2 respectively and formed between the two windings 3, 5. One or mote conductive panels 6, 7, such as steel panels 6, 7 may further be provided and engaged into the spaces 24, 25 of the ferrite base plate 2 respectively.

Figure 4:
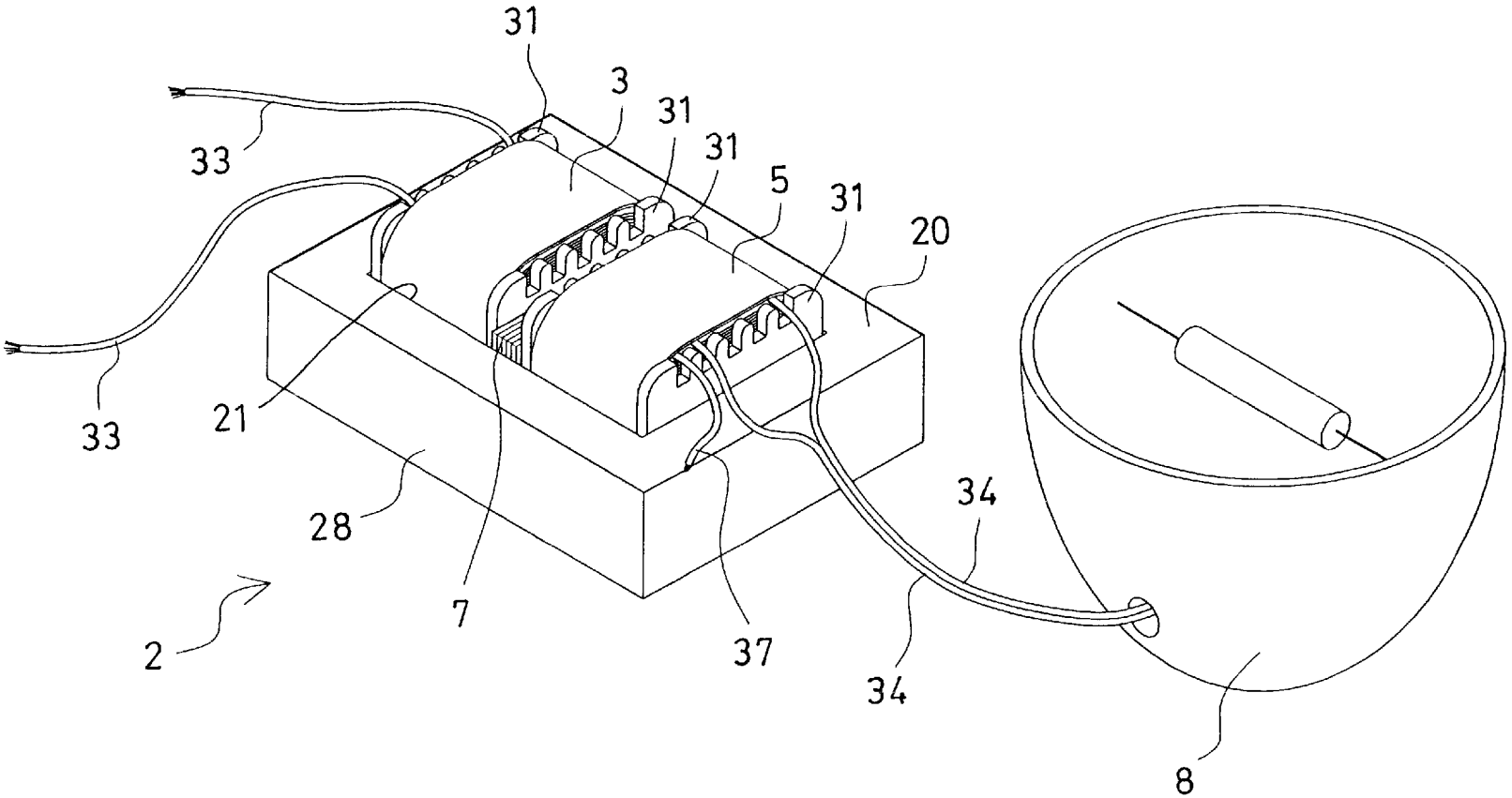
FIG. 4 is a perspective view illustrating the operation of the starter or the transformer for the light devices.

In operation, as shown in FIG. 4, the first winding 3 may be coupled to the electric power source with electric wires 33, for example. The other or the second winding 5 may be coupled to the electric facilities, such as the light device 8 with electric wires 34.

Once the windings 3, 5 are energized, a voltage more than 1200 volts may be generated by the windings 3, 5. However, the conductor panels 6, 7 may slightly lower and stabilize the voltage generated by the windings 3, 5, in order to provide a stabilized electric power to start or to energize the electric facilities, such as the light device 8.

The starter or the transformer may further include a ground 37 coupled to one of the windings 3, 5, such as the winding 5 for grounding purposes, and for preventing the starter or the transformer from being over loaded or from being shorted.

An insulating strap 28 may further be provided and wound around the ferrite base plate 2 of the transformer for positioning or securing the ground 37 to the ferrite base plate 2 of the transformer, and for preventing the ground 37 from moving relative to the ferrite base plate 2 of the transformer.

Accordingly, the starter or the transformer in accordance with the present invention may be used for safely controlling or for energizing light devices and for providing a stabilized electric power output to energize the light devices or the other electric facilities.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A transformer for electric facilities, said transformer comprising:

a ferrite base plate including a chamber formed therein, a first winding and at least one second winding engaged in said chamber of said ferrite base plate, said first and said at least one second windings being electrically coupled together, and separated from each other, a ground coupled to said at least one second winding, and an insulating strap wound around said ferrite base plate, and engaged with said ground, for securing said ground to said ferrite base plate.

2. The transformer according to claim 1, wherein said ferrite base plate includes a plurality of plates secured together.

3. The transformer according to claim 1 further comprising two pairs of partitions engaged in said chamber of said ferrite base plate, and disposed on sides of said first and said at least one second windings respectively.

4. The transformer according to claim 3 further comprising at least one conductive panel engaged between said two pairs of partitions.

* * * * *